United States Patent [19]

Richmond

[11] Patent Number: 4,895,388

[45] Date of Patent: Jan. 23, 1990

[54] PAIR OF SKIS

[76] Inventor: William D. Richmond, 386 Antlers Dr., Rochester, N.Y. 14618

[21] Appl. No.: 373,639

[22] Filed: Jun. 26, 1989

Related U.S. Application Data

[63] Continuation of Ser. No. 195,026, May 17, 1988, abandoned.

[51] Int. Cl.[4] ..... A63C 5/04

[52] U.S. Cl. ..... 280/609; 280/601; 280/602

[58] Field of Search ..... 280/601, 602, 609; 441/68

[56] References Cited

U.S. PATENT DOCUMENTS

| | | | |
|---|---|---|---|
| 2,188,582 | 1/1940 | Serr . | |
| 2,403,885 | 7/1946 | Thompson . | |
| 2,485,756 | 10/1949 | Meehan . | |
| 2,539,224 | 1/1951 | Beerli . | |
| 2,918,293 | 12/1959 | Tavi . | |
| 3,300,226 | 1/1967 | Reed, Jr. . | |
| 3,304,095 | 2/1967 | Carlton . | |
| 3,318,609 | 5/1967 | Ross . | |
| 3,326,564 | 6/1967 | Heuvel . | |
| 3,398,968 | 8/1968 | Mutzhas . | |
| 3,501,160 | 3/1970 | Lange . | |
| 3,520,546 | 7/1970 | Joseph . | |
| 3,537,717 | 11/1970 | Caldwell . | |
| 3,747,947 | 7/1973 | Gunzel . | |
| 3,801,117 | 4/1974 | Pierce . | |
| 3,820,802 | 6/1974 | Davis . | |
| 3,834,722 | 9/1974 | Rainer . | |
| 4,154,457 | 5/1979 | Auer et al. . | |
| 4,199,169 | 4/1980 | Guenzel et al. . | |
| 4,211,433 | 7/1980 | Pedersen . | |
| 4,377,297 | 3/1983 | Staufer . | |
| 4,405,149 | 9/1983 | Piegay . | |
| 4,438,946 | 3/1984 | Piegay . | |
| 4,487,426 | 12/1984 | Nishizawa . | |
| 4,565,386 | 1/1986 | Crainich . | |
| 4,568,100 | 2/1986 | Eriksson . | |
| 4,592,567 | 6/1986 | Sartor | 280/602 |
| 4,696,487 | 9/1987 | Girard | 280/602 |
| 4,700,967 | 10/1987 | Meatto et al. | 280/609 |

FOREIGN PATENT DOCUMENTS

| | | | |
|---|---|---|---|
| 887781 | 12/1971 | Canada | 280/609 |
| 262116 | 5/1968 | Fed. Rep. of Germany | 280/609 |
| 272164 | 6/1969 | Fed. Rep. of Germany | 280/609 |
| 2559673 | 8/1985 | France | 280/609 |
| 595118 | 1/1978 | Switzerland | 280/609 |

*Primary Examiner*—Charles A. Marmor
*Assistant Examiner*—Tamara L. Finlay
*Attorney, Agent, or Firm*—Marjama & Pincelli

[57] ABSTRACT

A pair of skis suitable for both slalom and giant slalom ski racing. This is achieved by providing a pair of skis so that corresponding inside edges have the same sidecut. Each of the outside edges of the skis may have the same sidecut as the other, but different from the sidecut of the inside edges. When the skis are reversed, the outside edges become the inside edges, and the inside edges become the outside edges, either changing the skis' suitability from giant slalom or slalom, or from slalom to giant slalom. Stiffening plates can be attached to the skis to provide rigidity and stability required by the skis for giant slalom racing and removed for slalom racing.

5 Claims, 3 Drawing Sheets

PAIR OF SKIS

This is a continuation of application Ser. No. 195,026 filed May 17, 1988, now abandoned.

The present invention is directed to a pair of skis and more particularly to a pair of skis that can be used for both slalom and giant-slalom racing.

There are many types of downhill ski racing, the most common being slalom and giant slalom. A slalom race requires a skier to maneuver around a set course with a series of very short radius turns, while a giant slalom race requires the skier to maneuver through a set course with a series of long radius turns. Skis are generally designed to be used either for giant slalom or for slalom racing, but not for both. Existing combination skis are optimum for neither.

Skis during the act of skiing act as springs. The skis are compressed and decompressed quickly as the skier carves a turn, which can provide energy to push the skier ahead. During the entry of a turn, force is applied against the ski by the weight of the skier, thereby compressing the skis. As the skier exists the turn to go on to the next turn, the force of his weight on his ski is reduced and the ski returns to its normal shape, thereby providing acceleration.

A noncompressed ski contacts the snow at only two points along its edge, the front and tail of the ski. As the ski compresses, the rest of the ski's edge contacts the snow.

The shape of the sidecut and amount of flex of the ski determines whether the ski is better suited to carve a short or long radius turn. The amount of sidecut of the center portion of the ski determine the ability to carve sharper turns more easily. The deeper the sidecut of a ski the better it is suited for slalom racing, while shallow sidecuts are better suited for giant slalom racing. The stiffness of the ski also has an effect on the performance of the ski. The stiffer the ski the longer the radius it will carve and the more stable it will be.

Applicant has invented a single pair of skis which have the versatility of providing excellent capabilities for both slalom and giant slalom racing.

SUMMARY OF THE INVENTION

A pair of skis suitable for both slalom and giant slalom ski racing. This is achieved by providing a pair of skis so that corresponding inside edges have the same sidecut. Each of the outside edges of the skis have the same sidecut as the other, but different from the sidecut of the inside edges. When the skis are reversed, the outside edges become the inside edges, and the inside edges become the outside edges, either changing the skis' suitability from giant slalom or slalom, or from slalom to giant slalom. Stiffening plates can be attached to the skis to provide rigidity and stability required by the skis for giant slalom racing and removed for slalom racing.

DETAILED DESCRIPTION

Figure 1:
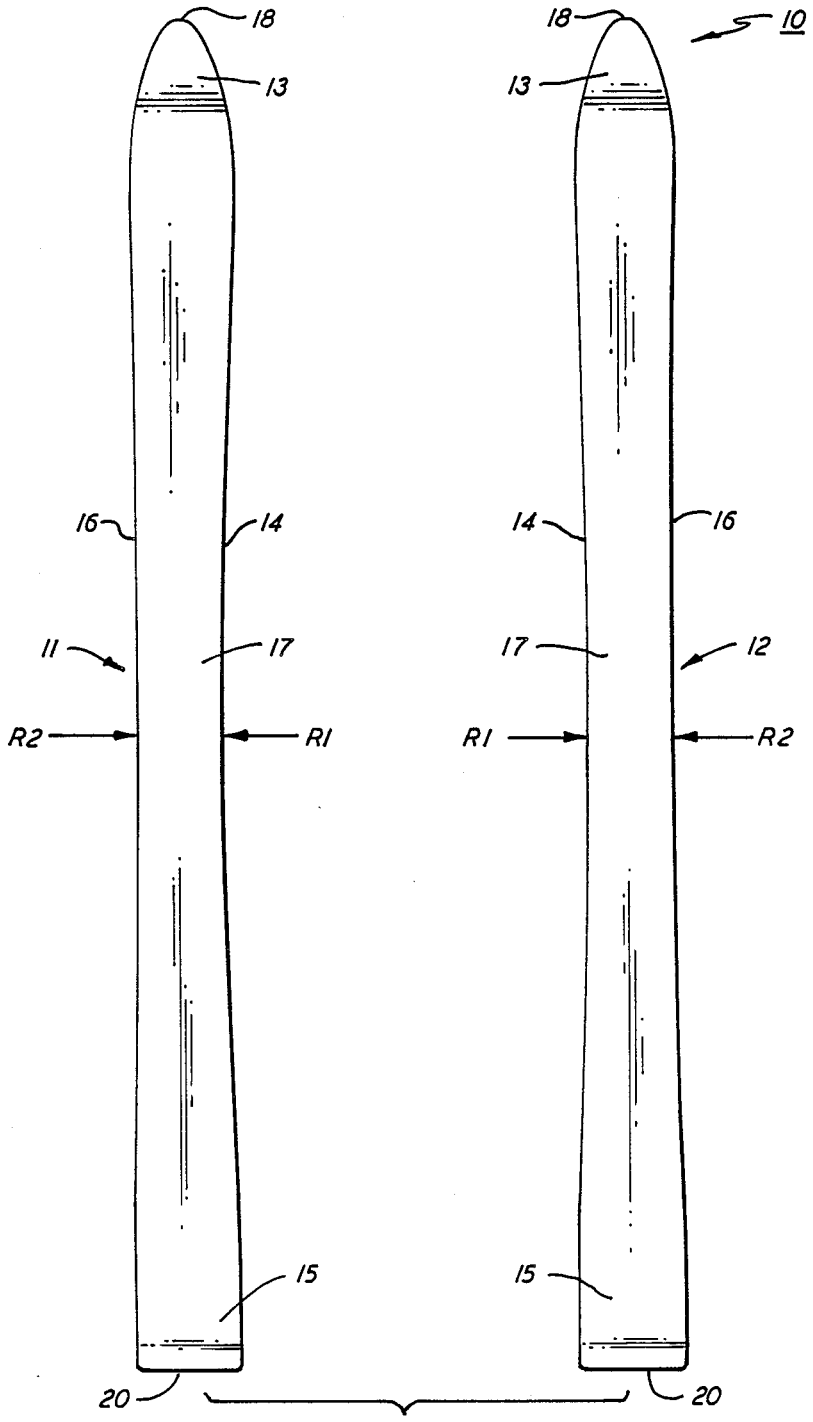
FIG. 1 is a top view of a pair of skis according to the present invention for use in slalom skiing.

Referring to FIG. 1, there is illustrated a pair of skis 10 made in accordance with the present invention. The skis 10 comprise a first interchangeable ski 11 and a second interchangeable ski 12. The skis 11, 12 each comprise a shovel portion 13 at the forward end, a tail section 15, a central section 17 connecting shovel portion 13 and tail section 15. Skis 11, 12 each have an inside edge 14 with a radius of curvature R1 and an outside edge 16 with a radius of curvature R2. For the purposes of the present invention, radii R1 and R2 are determined when the ski is tilted 30° from the horizontal plane and flexed so that the entire bottom edge contacts a fixed horizontal plane. The pair of skis 10 illustrated in FIG. 1 are shown in the position it would be used for slalom racing. Accordingly, the radius R1 would be less than R2. In slalom racing the radius R1 is generally between 25 and 55 meters and preferably between 35 and 45 meters.

Figure 2:
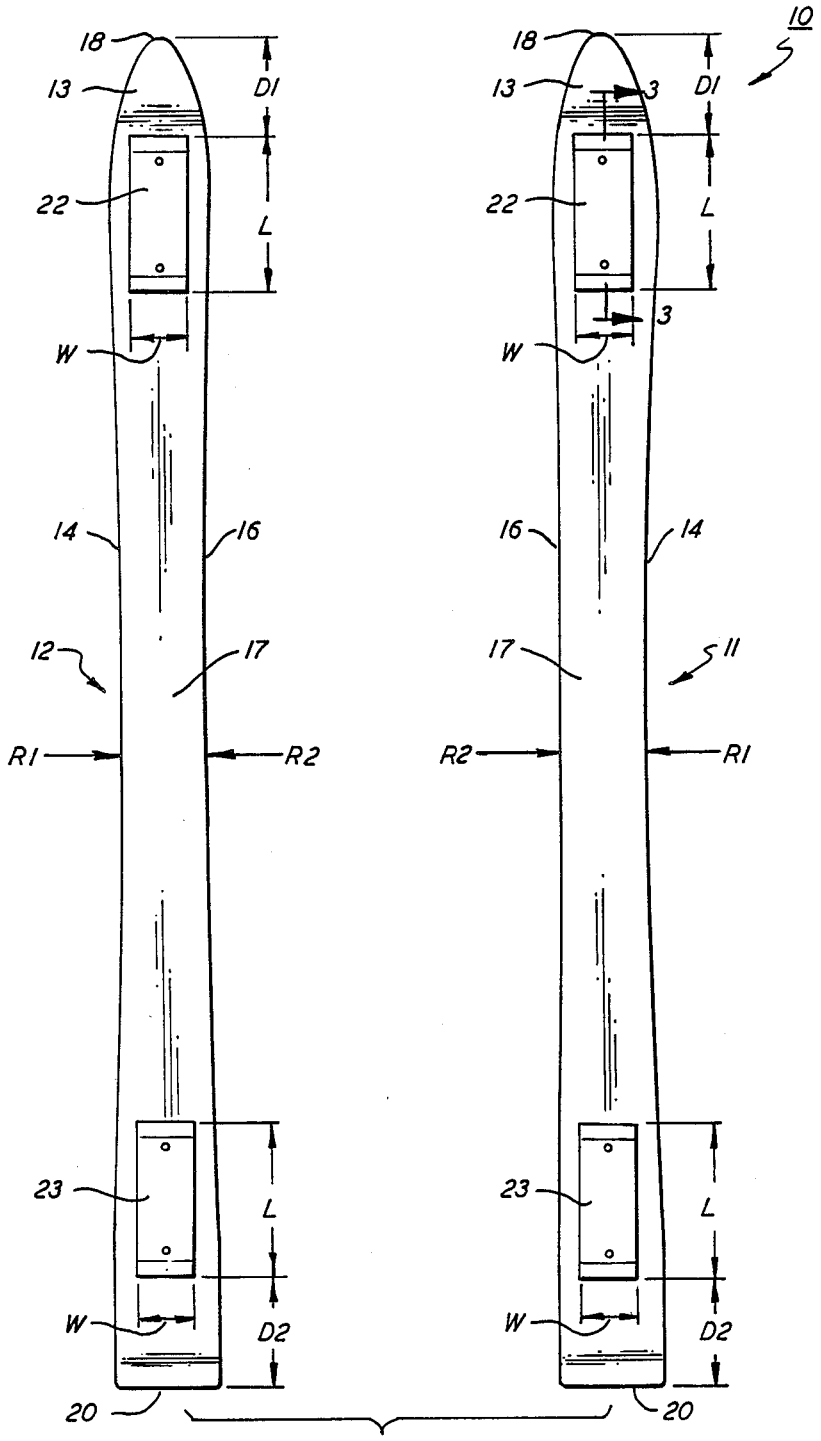
FIG. 2 is a top view of the pair of skis for use in giant slalom skiing showing the approximate desirable locations of stiffening plates.

Referring to FIG. 2, the skis 11, 12 are identical to that illustrated in FIG. 1, except that first interchangeable ski 11 has been placed on left side and the second interchangeable ski 12 has been placed on the right side to illustrate how the skis would be used for giant slalom. As can be seen, the outside edge 16 is now located on the inside part of the pair of skis 10 so that edges 16 of skis 11, 12 face each other. The edge 16 is such that the radius R2 is preferably between 35 and 75 meters preferably between 45 and 65 meters. The curvature of the sidecut typically extends from the shovel section 13 of the ski to the tail section 15 of the ski leaving approximately 15 to 20 centimeters at the tip 18 of the ski and approximately 5 to 10 centimeters from the end 20 of the ski to form the protective heel customarily found in most skis.

When the skis 10 are to be used in the giant slalom as illustrated in FIG. 2, a pair of stiffening plates 22, 23 are preferably added to each ski 11, 12 to stiffen the skis 10. The stiffening plates 22, 23 are of such a nature so as to provide a stiffening function to the shovel and tail sections of the ski. Stiffening plate 22 is spaced a distance D1 from the end of shovel section 13 and stiffening plate 23 is spaced a distance D2 from the end of tail section 15, respectively. The distance D1 being in the range of 10 to 45 cm and the distance D2 being in the range of 20 to 50 preferably D1 is between 10 to 30 cm and D2 is between 20 to 40 cm. In the particular embodiment illustrated, the distance D1 and D2 are approximately 35 centimeters. The stiffening plates have a length L and a width W. Typically, the length L and width W have a range of 20–35 cm (length) and 6–8 cm (width) and are such that they are of sufficient strength to provide a stiffening effect to resist flexing of the skis 10. In the particular embodiment illustrated, the stiffening plates have a length of 30 cm and a width 8 cm. The amount of stiffening can be varied as desired as in response to the amount of weight of the skier or in response to the inherent stiffness of the interchangeable skis 11, 12.

The stiffening plate 22, when attached, preferably increase the effort to flex the ski by 10–20% above the effort required to flex the skis without the plates. Typically, skis without stiffening plates have a stiffness in the range of 29–36 Nt/cm, with the stiffening plates, the skis 11, 12 each have a stiffness in the range of 34–40 Nt/cm, preferably in the range of 36–38 Nt/cm.

Figure 3:
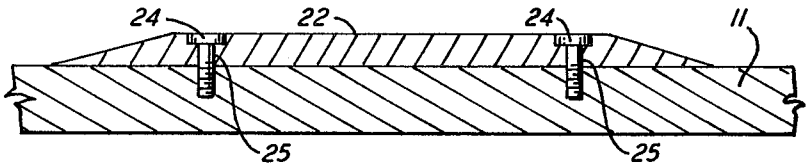
FIG. 3 is an enlarged sectional view of one of the skis of FIG. 2 taken along line A—A.

Referring to FIG. 3, there is illustrated how the stiffening plates 22, 23 may be secured to the skis 11, 12. In the particular embodiment illustrated, the stiffening plates 22, 23 are each secured to the skis by a pair of screws 24 which extend through openings 25 in each plate 22, 23 and threaded into skis 11, 12. However, the plates 22, 23 may be secured to skis 11, 12 in any desired manner.

Figure 4:
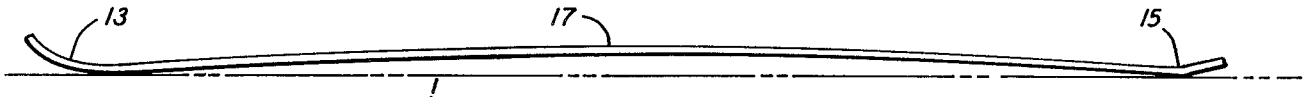
FIG. 4 is a side view of the ski of FIG. 1 in the unflexed position.
Figure 5:
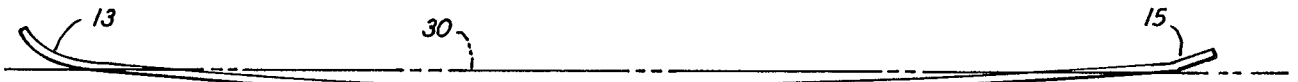
FIG. 5 is a side view of the ski of FIG. 4 in the flexed position.

Referring to FIG. 4, there is a side view of a ski in accordance with the present invention without stiffening plates and in the unflexed state (i.e. when no weight is being applied to the ski) with respect to a horizontal plane 30. Referring to FIG. 5, there is illustrated a side view of the ski of FIG. 4 as it would be in the flexed position (i.e. the full weight of the skier in a turn). It can be seen that the center portion 17 of the ski flexes to a point below the horizontal plane 30 such that the front section 13 and tail section 15 are above the center section 17 so as to provide somewhat of a concave shape to the ski.

Figure 6:
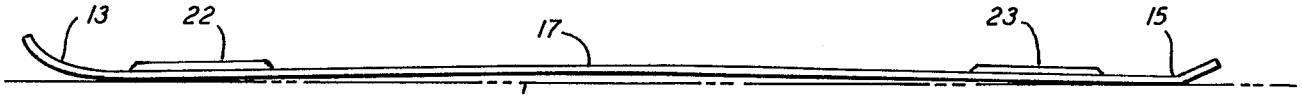
FIG. 6 is a side view of the ski of FIG. 2 in the unflexed position.
Figure 7:
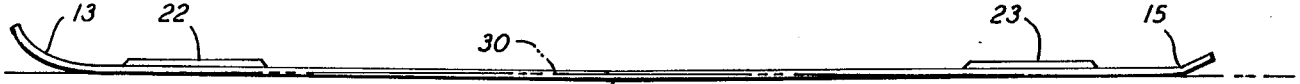
FIG. 7 is a profile of the ski of FIG. 6 in the flexed position.

Referring to FIG. 6, there is a profile of the ski with stiffening plates 24 attached thereto in the unflexed state. In FIG. 7, there is a side view of the ski of FIG. 6 when the ski is flexed, for example, during the curve in a giant slalom race. It can be seen that the ski is prevented from flexing to a point where the center is below the horizontal of the shovel and tail sections 13, 15. The particular amount of flexing can be adjusted by providing plates of different stiffness and strength so as to provide the performance desired by the skier. The stiffness qualities can be varied by the selection of the material from which plates 22 are made and/or by adjusting the thickness and size of the plate 27.

It is to be understood that various changes in modifications can be made to the present invention without departing from the scope of the present invention. For example, as previously noted, the size and shape of the stiffening plates may be selected to provide the appropriate stiffening desired by the skier. Additionally, the amount of the sidecut for either of the side edge 14 or outside edge 16 may be varied in accordance with the handling characteristics desired by the skier.

What is claimed is:

1. A single pair of skis suitable for use in both giant slalom or slalom skiing comprising:

a first interchangeable ski for use on either the right or left foot of the user having a right edge and left edge, said right edge having a first concave curvature said left edge having a second concave curvature having a radius smaller than said first concave curvature and;

a second interchangeable ski for use on either the right or left foot of the user having a right edge and the left edge, said right edge having a curvature substantially equal to that of said second concave curvature of said left edge of the first ski and said left edge of said second ski having a curvature substantially equal to said first concave curvature of said right edge of the first ski, said first curvature being specifically designed for giant slalom turns and said second curvature being designed for shorter slalom turns; wherein said first interchangeable ski being used on the right foot of the skier and said second interchangeable ski being used on the left foot of the skier when slalom skiing; and, said first interchangeable ski being used on the left foot of the skier and said second interchangeable ski being used on the right foot of the skier when giant slalom skiing.

2. A pair of skis according to claim 1 further characterized by said first and second skis each having a removable forward stiffening member at the front and a second stiffening member at the rear, said stiffening members decrease flexibility as required for giant slalom racing and, when removed, increase flexibility for slalom racing.

3. A pair of skis according to claim 2 wherein said stiffening member increases the effort to flex said skis by 10–20%.

4. A pair of skis according to claim 2 wherein each of said skis have a stiffness in the range of 34–40 Nt/cm.

5. A pair of skis according to claim 2 wherein each of said skis have a stiffness in the range of 36–38 Nt/cm.

* * * * *